US011548054B2

(12) United States Patent
Martin

(10) Patent No.: US 11,548,054 B2
(45) Date of Patent: Jan. 10, 2023

(54) DOUBLE SEAM MODIFICATION TOOLING APPARATUS AND DOUBLE SEAM MODIFICATION PROCESS

(71) Applicant: N2 PACKAGING SYSTEMS, LLC, Twin Falls, ID (US)

(72) Inventor: Randy Scott Martin, Kimberly, ID (US)

(73) Assignee: N2 PACKAGING SYSTEMS, LLC, Twin Falls, ID (US)

( * ) Notice: Subject to any disclaimer, the term of this patent is extended or adjusted under 35 U.S.C. 154(b) by 239 days.

(21) Appl. No.: 17/109,246

(22) Filed: Dec. 2, 2020

(65) Prior Publication Data

US 2022/0168797 A1 Jun. 2, 2022

(51) Int. Cl.
*B21D 51/32* (2006.01)
*B21D 51/26* (2006.01)
*B65D 6/30* (2006.01)

(52) U.S. Cl.
CPC ..... *B21D 51/32* (2013.01); *B21D 51/2661* (2013.01); *B65D 7/36* (2013.01)

(58) Field of Classification Search
CPC ..... B21D 51/2661; B21D 51/2653; B21D 51/2615; B21D 51/2669; B21D 51/2684; B21D 51/32; B21D 51/30–34; B21D 51/44; B21D 51/48; B21D 51/50
USPC ..... 413/31
See application file for complete search history.

(56) References Cited

U.S. PATENT DOCUMENTS 3,057,265 A * 10/1962 Leibreich ..... B21D 51/32 493/109
4,626,158 A * 12/1986 Le Bret ..... B21D 51/32 413/4
2020/0406337 A1* 12/2020 Ross ..... B65D 41/125

* cited by examiner

*Primary Examiner* — Adam J Eiseman
*Assistant Examiner* — Fred C Hammers
(74) *Attorney, Agent, or Firm* — Richard D. Clarke

(57) ABSTRACT

The present application is directed to a double seam modification tooling apparatus for double seam modification and the double seam modification process. More particularly, a tooling apparatus for double seam modification is provided which adds a third modification operation to the first and second double seam operations which form the finished double seam, as well as a process for modifying double seams to include patterns of integral slots, notches or threads, or the like, after the double seams have been previously completely formed by the double seam modification tooling apparatus. Child resistant lids can then be configured with mating tab notches or tab threads to allow for opening or closing the lid when the tabs are properly aligned with the notches and threads on the can rim modified double seams.

18 Claims, 10 Drawing Sheets

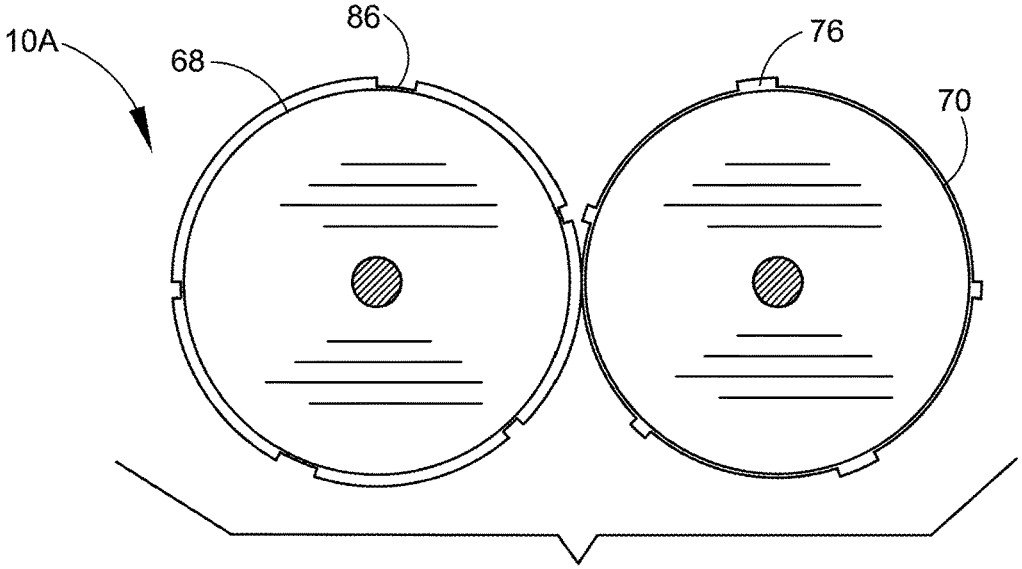
FIG. 29
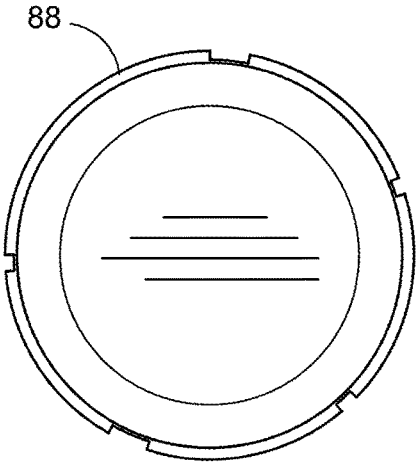
FIG. 30
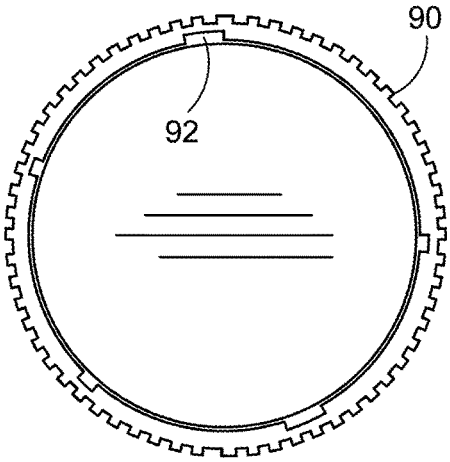
FIG. 31
FIG. 32
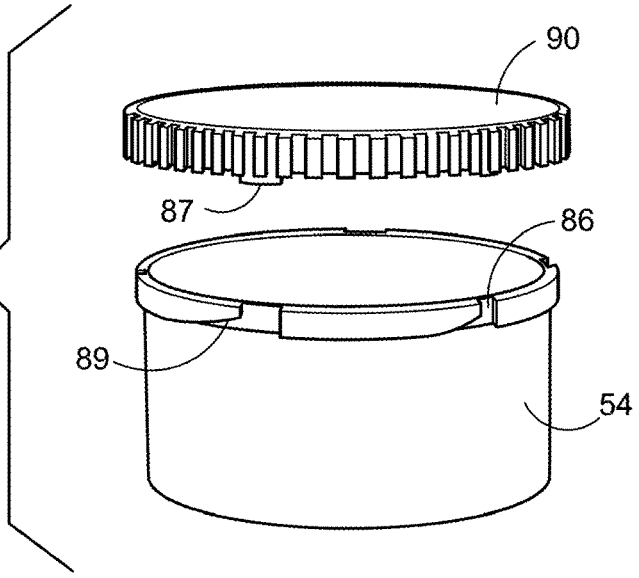

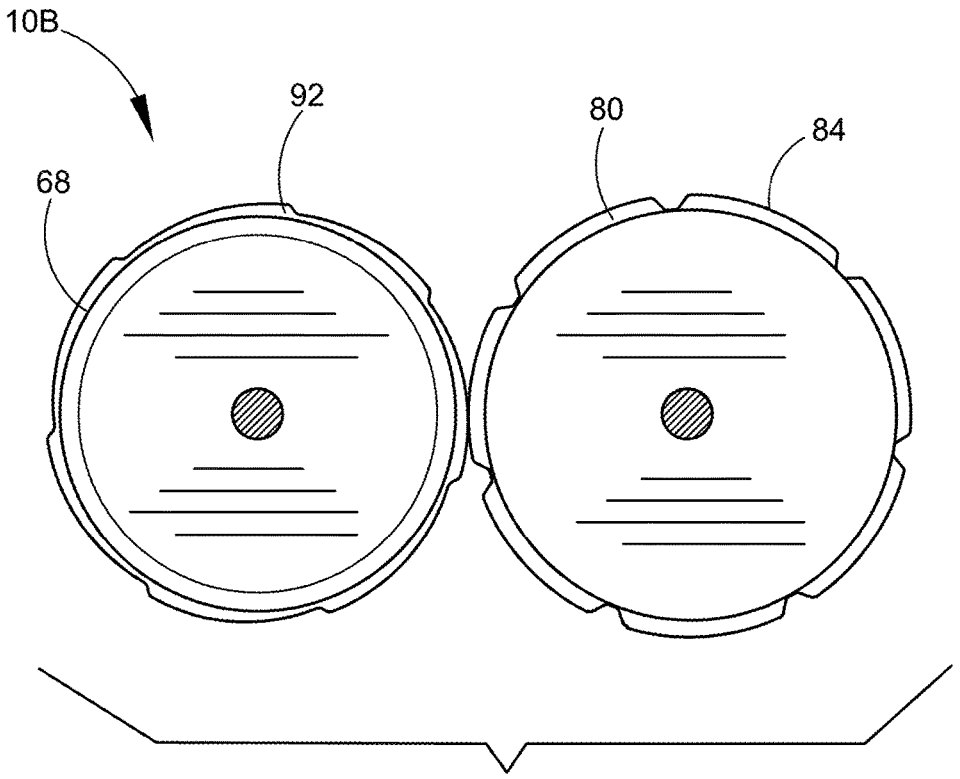
FIG. 33
FIG. 34
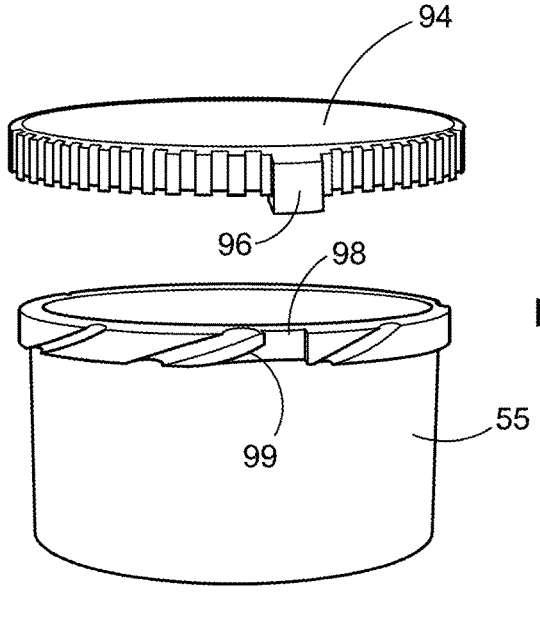
FIG. 35
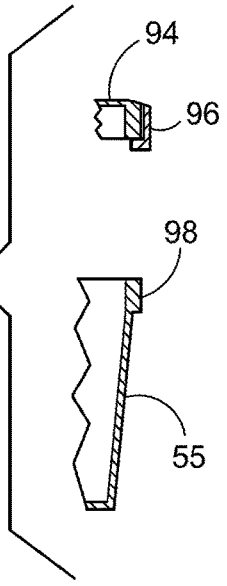

DOUBLE SEAM MODIFICATION TOOLING APPARATUS AND DOUBLE SEAM MODIFICATION PROCESS

FIELD OF THE INVENTION

This application relates to a double seam modification tooling apparatus for double seam modification and the double seam modification process. More particularly, a tooling apparatus for double seam modification is provided which adds a third modification operation to the first and second double seam operations which form the finished double seam, as well as a process for modifying double seams to include patterns of integral slots, notches or threads, or the like, after the double seams have been previously completely formed by the double seam modification tooling apparatus.

BACKGROUND OF THE INVENTION

Canned foods are among the safest food processed today. Approximately 60% of food consumed in the United States is thermally processed and packaged in hermetically sealed containers. However, regardless of the safety assured in canned foods, any damaged or defective canned products are a potential public health problem. Defective cans may leak and allow microorganisms to enter that may cause food poisoning or other significant threat and a potential public health problem to consider when dealing with serious defective/damaged canned food containers requiring inspection, evaluation and sampling. It is imperative that canned food products with visual and/or external defects be recognized. Those containers with "critical defects" should not be sold, distributed or consumed. Those containers with "major defects" may become a public health concern and should not be marketed without testing before sale. However, canned food with "minor defects" normally represent no public health hazard, i.e. if the hermetic seal on the can has not been jeopardized, these products are generally considered safe and, when properly labeled, such products are acceptable for distribution and sale.

Conventionally, cans are sealed by applying a lid using the well-known double seaming process. This is most typically performed on a rotational type machine having multiple spindles. Each spindle or station contains a seaming chuck which acts as an anvil to support the can end unit while two freely rotating round seaming rolls are brought into contact towards the can axis using a cam motion. Each of the seaming rolls is formed with specific groove geometry to work the metal into what is a commercially accepted double seam. The seaming rolls are mounted in bearings and are rotated co-incident to contact with the can body and the end unit. This diameter is reduced in the act of double seaming and leaves a smooth, well rounded edge to the juncture of the can body and end unit. Latest metals technology has allowed for plastic laminates and specialized coatings to be applied to the steel. This protects the steel from oxidation in wet, damp environments.

Nearly all canned foods and beverages are hermetically sealed within a container using the double seam canning process. A double seam is a canning process for sealing a tin can by mechanically interlocking the can body and a can end (or lid). Originally, the can end was soldered or welded onto the can body after the can was filled. However, this introduced a variety of issues, such as foreign contaminants (including lead and other harmful heavy metals). The double seam was later developed as a cheaper and safer alternative and quickly replaced the welded seam.

The double seam is made using a double seamer tooling apparatus, which can have just one or a number of heads or seaming stations. The double seam is formed by mechanically interlocking five layers of material together: three layers of the can end and two layers of the can body. Each seaming head typically consists of two rolls, a first operation roll and second operation roll, and a chuck. Some seaming machines have two first operation rolls and two second operation rolls and a few machines use a method called "rail seaming" which requires no rolls.

During the seaming operation, the can end is lowered on to the filled can body and held down by the chuck, which acts as an anvil to the seaming operation. The first operation roll then engages the can end against the can body thereby folding the end curl around the flange of the body. In some seaming machines, this is done as the can is turning at high speed. In other seaming machines, the can is stationary and the first operation roll (or rolls) spins around several times to ensure a complete first operation. After the first operation is complete, the first operation roll disengages from the can and the second operation roll then engages the can. The purpose of the second operation is to iron out the double seam into its final shape and remove the voids between the layers of can and end material. In practice, ironing out all of the can and end material in a double seam without leaving some voids is impossible without the use of a sealing compound.

The production of a high-quality double seam is dependent on several factors, including conformity to the set can and end specifications, the quality of the seamer tooling used and its compliance with the can and end being used, the condition of the seaming machine and the setup of the seaming rolls, lifter pressure and other components. When the machinery is set up correctly and the incoming materials (cans, ends, tooling, etc.) comply to the set specifications, the result should be ideal first and second operation seams. A problem in any one of these factors and others can contribute to seam defects that have an adverse effect on the ability of the can to withstand foreign contamination and keep the product from leaking or reduce its shelf life.

A double seamer is defined as a closing machine that rolls together the rims and lids of metal cans to make a hermetic seam. As described above, this double seam process is accomplished in two separate operations utilizing a seaming head having one seaming chuck per head and two seam rolls, one first operation seam roll and one second operation seam roll. The seaming chuck holds the end or lid in place while the body of the can is pushed into it. As the chuck holds the lid in position, the first operation roll will roll around and perform the first operation creating the first operation seam. Next, the second operation roll comes in and tightens up the seam. The ed will have compound material on it, which acts almost like a gasket, ensuring that the closure is completely sealed and air-tight. This allows the seam to prevent loss of internal pressure as well as insuring that no hazardous materials can enter the sealed double seam.

Double seamer machines have been available for approximately 100 years. There are many available today on the open market. Over the last 100 years, numerous new and useful improvements to the double seamer machine and its associated machine parts, such as seaming heads, have been patented.

U.S. Pat. No. 1,695,210 was granted to M. M. Sedwick and Continental Can Company in 1928 for improvements in the seaming head claiming a seaming head for closing machines including a chuck for engaging a can end and holding the same on the can body, a body portion, said chuck and body portion having a relative rotation, seaming levers carried by said body portion, a seaming roll mounted to rotate free y on each seaming lever, and yielding means associated with said chuck and adapted to engage the seaming rolls at the outer edge portion thereof for causing said seaming rolls to rotate on their respective levers.

Many years later, U.S. Pat. No. 7,399,152 was granted to J. J. Domijan in 2008, incorporated by reference herein, disclosing an apparatus for double seaming an end unit to a can body includes, as is conventional, a double seaming chuck, a double seaming roll and a mechanism for selectively moving the double seaming roll toward the double seaming chuck to perform a double seaming operation. Most advantageously, a drive mechanism is provided for driving the double seaming chuck and the double seaming roll at respective speeds that are selected so as to reduce relative rotational speed between the double seaming roll and a workpiece when the double seaming roll comes into contact with the workpiece during the double seaming operation.

In US Patent Application Publication 2004/0197164 A1 published in 2004, Carrein et al. described a seaming machine for use with a container and an end closure. The machine includes a seaming head with multiple shaft assemblies and a lifter table located below the seaming head and including multiple container stations. During use, the lifter table and seaming head rotate in unison about the centerline of a spindle. A single shaft assembly is provided at each station to perform a two-step seaming operation on its corresponding container. In one embodiment, a seaming cam is located above the seaming head for moving first and second cam followers, in the shaft assembly. In another embodiment, the cam followers and have a master/slave relationship dependent on which step of the seaming operation is being conducted. In another embodiment, a single piece plate is used in a cover feed assembly and provides end closures to a make-up point.

In US Patent Application Publication 2018/0078991 A1 published in 2018, incorporated by reference herein, Obata et al. described a seaming device that makes it possible to easily adjust an axial load applied to a can during seaming and that makes it possible to prevent the buckling of the can without any shock load being applied, apply a constant axial load according to a decrease in the height of the can during the seaming, and achieve the high speed of a seaming process. The seaming device has a can placement unit that places a can (C), a chuck unit provided opposite the can placement unit, and a seaming roll that seams a lid (F) onto the can (C). The can placement unit has a pressing mechanism that operates by fluid pressure and elastically upwardly presses a plate on which the can (C) is placed.

Therefore, for the past 100 years or so, with all of the improvements made to the seaming device and process, there has been no introduction of a seaming device capable of a third operation which entails modification of the double seam as formed in the first two prior art operations of folding and compressing the double seam.

In this regard, it would be highly desirable to have a third operation which modifies the formed double seam after it is completed, in order to design child resistant lids capable of mating with the types of double seam modifications generated by the tooling apparatus and the process. The third operation modification of the formed double seam could be in the form of slots, notches or threads, or the like, or many other configurations which enable a child resistant lid to be configured, designed and fabricated to fit on the modified double seam.

In this respect, before explaining at least one embodiment of the Double Seam Modification Tooling Apparatus and Double Seam Modification Process in greater detail, it is to be understood that the design is not limited in its application to the details of construction and to the arrangement of the components set forth in the following description or illustrated in the drawings. The Double Seam Modification Tooling Apparatus and Double Seam Modification Process is capable of other embodiments and of being practiced and carried out in various ways. Also, it is to be understood that the phraseology and terminology employed herein are for the purpose of description and should not be regarded as limiting.

SUMMARY OF THE INVENTION

The preferred embodiment of the Double Seam Modification Tooling Apparatus and Double Seam Modification Process provides a double seam tooling device which includes a third operation modification chuck and third operation modification roller assembly which enables the process of modifying a double seam after that double seam has been completed as applied to a double seamed can. The third operation modification roller may be configured to punch notches in the completed double seam, and alternatively configured to punch threads into the completed double seams.

The primary advantage of the Double Seam Modification Tooling Apparatus and Double Seam Modification Process is that it provides a tooling configuration capable of modifying a completed double seam on a can rim.

Another advantage of the Double Seam Modification Tooling Apparatus and Double Seam Modification Process is that it provides a process of using tooling capable of modifying a completed double seam on a can rim, to modify completed double seams.

Yet another advantage of the Double Seam Modification Tooling Apparatus and Double Seam Modification Process is that it provides tooling for a third operation, wherein that third operation modifies a double seam.

A further advantage of the Double Seam Modification Tooling Apparatus and Double Seam Modification Process is that it provides tooling for a third operation, wherein that third operation modifies a double seam by notching the double seam.

Another advantage of the Double Seam Modification Tooling Apparatus and Double Seam Modification Process is that it provides tooling for a third operation, wherein that third operation modifies a double seam by threading the double seam.

These together with other advantages of the Double Seam Modification Tooling Apparatus and Double Seam Modification Process, along with the various features of novelty, which characterize the design are pointed out with particularity in the claims annexed to and forming a part of this disclosure. For a better understanding of the Double Seam Modification Tooling Apparatus and Double Seam Modification Process its operating advantages and the specific objects attained by its uses, reference should be made to the accompanying drawings and descriptive matter in which there are illustrated the preferred and alternate embodiments of the Double Seam Modification Tooling Apparatus and Double Seam Modification Process. There has thus been outlined, rather broadly, the more important features of the design in order that the detailed description thereof that follows may be better understood, and in order that the present contribution to the art may be better appreciated. There are additional features of the Double Seam Modification Tooling Apparatus and Double Seam Modification Process that will be described hereinafter, and which will form the subject matter of the claims appended hereto.

The preferred embodiment of the Double Seam Modification Tooling Apparatus and Double Seam Modification Process will include a third modification operation turret having a third modification operation chuck and a third modification operation roller wherein said roller will include notching punches therein for the purpose of modifying the double seam by punching notches into the competed double seam following operations one and two. Notching of the double seam enable child resistant lids to be configured with notch tabs to mate with the notched double seam can rims.

In alternate embodiments of the Double Seam Modification Tooling Apparatus and Double Seam Modification Process will include a third modification operation turret having a third modification operation chuck and an alternate third modification operation roller wherein said roller will include threading punches therein for the purpose of modifying the double seam by punching threads into the competed double seam following operations one and two. Threading of the double seam enable child resistant lids to be configured with thread tabs to mate with the threaded double seam can rims.

Double Seam Modification Tooling Apparatus and Double Seam Modification Process primary features will include as prominent design and operational features: (1) a third operation modification chuck and a third operation modification roller configured to modify a completed double seam by notching the double seam; and (2) a third operation modification chuck and an alternate third operation modification roller configured to modify a completed double seam by threading the double seam. Both notching and threading of the double seam enable child resistant lids to be configured to mate with the notched and threaded double seam can rims.

With respect to the above description then, it is to be realized that the optimum dimensional relationships for the parts of the Double Seam Modification Tooling Apparatus and Double Seam Modification Process, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present design. Therefore, the foregoing is considered as illustrative only of the principles of the Double Seam Modification Tooling Apparatus and Double Seam Modification Process. Further, since numerous modifications and changes will readily occur to those skilled in the art, it is not desired to limit the Double Seam Modification Tooling Apparatus and Double Seam Modification Process to the exact construction and operation shown and described, and accordingly, all suitable modifications and equivalents may be resorted to falling within the scope of this application.

BRIEF DESCRIPTION OF THE DRAWINGS

The accompanying drawings, which are incorporated in and form a part of this specification, illustrate embodiments of the Double Seam Modification Tooling Apparatus and Double Seam Modification Process and together with the description, serve to explain the principles of this application.

FIG. 29 depicts a top plan view of the third operation double seam modification roller punching notches into the completed double seam on the lid of a can.

FIG. 30 depicts a top plan view of a modified lid wherein the modification of the double seam was notching the completed double seam.

FIG. 31 depicts a bottom plan view of a child resistant lid which is configured to be applied to the modified notched double seam rim of a can by mating the modified notched double seam notches with the notches in the child resistant lid.

FIG. 32 depicts a child resistant notched lid and a notched double seam modified can rim on a double seamed can wherein the lid is configured to be mated with the modified double seam notches applied by double seam modification to the double seam rim of the can.

FIG. 33 depicts a top plan view of the third operation double seam modification roller punching threads into the completed double seam on the lid of a can.

FIG. 34 depicts a child resistant threaded lid and a threaded double seam modified can rim on a double seamed can wherein the lid is configured to be mated with the modified double seam threads applied by double seam modification to the double seam rim of the can.

FIG. 35 depicts a cross-sectional view of the child resistant lid and a partial cross section of the can rim illustrating a nib on the lid for securing the lid to the can once the lid is threaded on to the threaded double seam modified can rim.

DETAILED DESCRIPTION OF THE PREFERRED EMBODIMENTS

As required, the detailed embodiments of the present and Double Seam Modification Process 10A and 10B are disclosed herein, however, it is to be understood that the disclosed embodiments are merely exemplary of the design that may be embodied in various forms. Therefore, specific functional and structural details disclosed herein are not to be interpreted as limiting, but merely as basic for the claims and as a representative basis for teaching one skilled in the art to variously employ the present design in virtually any appropriately detailed structure as well as combination.

Figure 1:
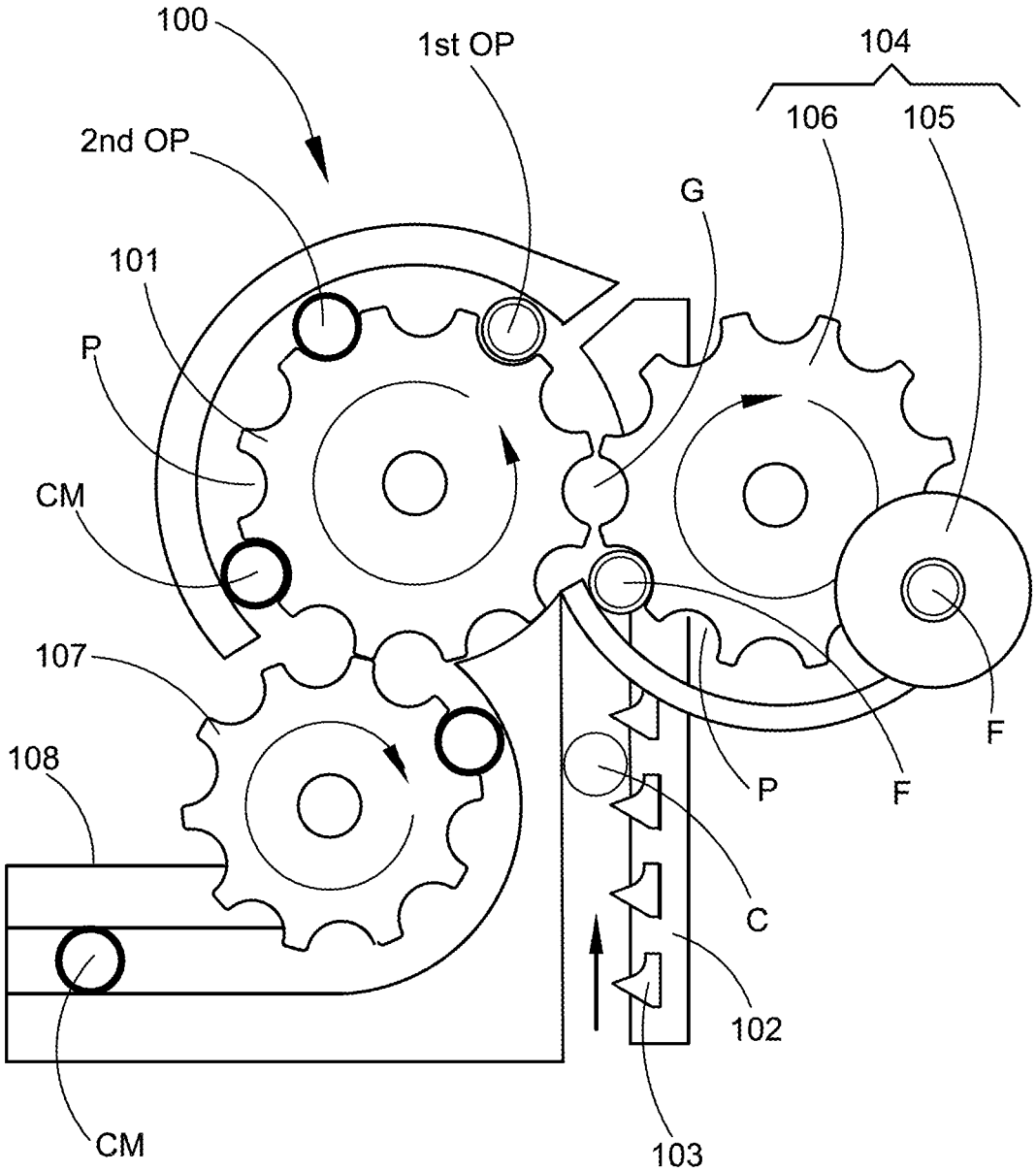
FIG. 1 PRIOR ART
FIG. 1 depicts top plan overall view of a conventional prior art seaming device disclosed by Obata et al. in 2018 having three turrets, a lid conveyance turret, a seaming zone turret and a discharge turret.

FIG. 1 depicts a conventional prior art seaming device disclosed by Obata et al. in 2018, and US Patent Application Publication 2018/0078991 A1 is hereby incorporated by reference herein. As shown in FIG. 1, a seaming device 100 according to an embodiment of the prior art invention has a seaming turret 101 that performs the step of seaming a can C and a lid F, after the can and lid meet at a can-lid merging point G between the lid conveyance turret 106 and the seaming turret 101. The conventional double seaming operation occurs in two separate operations known as double seaming operation 1 (here labeled $1^{st}$ OP on the drawing figure) and double seaming operation 2 (here labeled $2^{nd}$ OP on the drawing figure, wherein both operations are discussed in greater detail below).

As illustrated here in FIG. 1, an infeed conveyor 102 that supplies the can C onto which the lid F has not been seamed to the seaming turret 101, a lid supply unit 104 that has a lid supply device 105 to supply the lid F and a lid conveyance turret 106, a discharge turret 107 that carries out the double seamed can CM onto which the lid F has been seamed from the seaming turret 101, and a carrying-out conveyor 108 that carries out the double seamed can CM from the discharge turret 107 to an outside. Each of the seaming turret 101, the discharge turret 107, and the lid conveyance turret 106 has pockets P that separately accommodate and convey the cans C and the double seamed can CM and the lid F at their outer peripheral parts, and the infeed conveyor 102 has attachments 103 that separately engage and convey the can C.

Each of the seaming turret 101, the discharge turret 107, and the lid conveyance turret 106 has pockets P that separately accommodate and convey the cans C and the double seamed can CM and the lid F at their outer peripheral parts, and the infeed conveyor 102 has attachments 103 that separately engage and convey the can C. Rotation speeds of the seaming turret 101, the discharge turret 107, and the lid conveyance turret 106, a movement speed of the attachments 103 of the infeed conveyor 102, and a timing at which the respective pockets P and the attachments 103 work together are adjustably designed so that the cans C and the double seamed can CM and the lid F are smoothly transferred between the respective turrets and the conveyors. Turret directions of rotation are indicated by the arrows.

Figure 2:
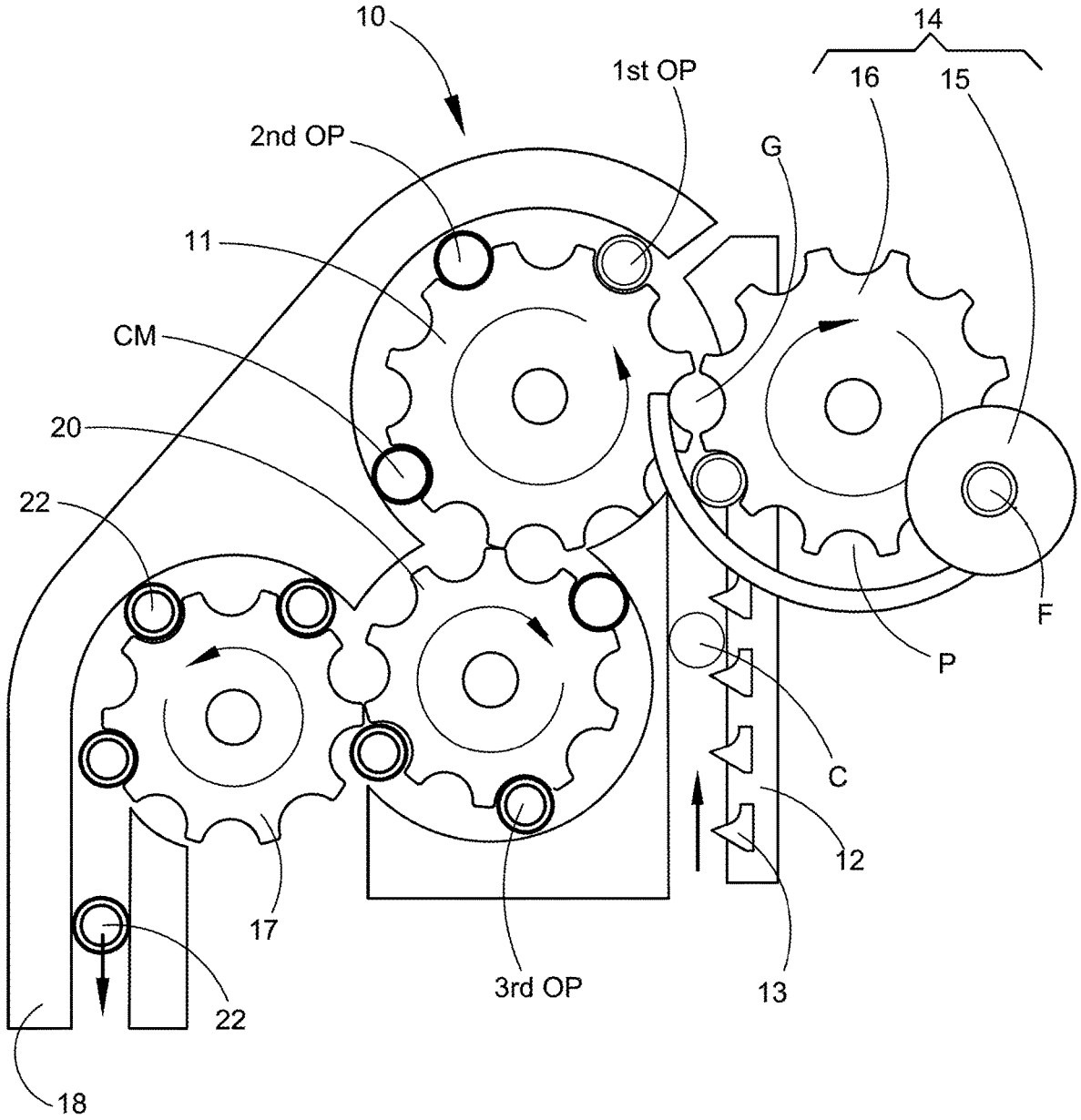
FIG. 2 illustrates a top plan overall view of the Double Seam Modification Tooling Apparatus and Double Seam Modification Process seaming device of the present invention having four turrets, including a seam modification zone turret located between the seaming zone turret and the discharge turret, which facilitates the double seam modification third operation according to the present invention.

FIG. 2 illustrates an overview of the double seam modification tooling apparatus for double seam modification 10 constructed in accordance with the present invention. As shown in FIG. 2, the double seam modification tooling apparatus for double seam modification 10 according to an embodiment of the present invention has a seaming turret 11 that performs the step of seaming a can C and a lid F, after the can and lid meet at a can-lid merging point G between the lid conveyance turret 16 and the seaming turret 11. The double seaming operation occurs in two separate operations known as double seaming operation 1 ($1^{st}$ OP) and double seaming operation 2 ($2^{nd}$ OP, wherein both operations are discussed in greater detail below). Additionally, there is a third operation turret 20 which accepts the double seamed can and modifies the double seam to generate a can with a modified double seam 22 (here labeled as $3^{rd}$ OP on the drawing figure, wherein this third operation will be discussed in greater detail below).

As illustrated here in FIG. 2, an infeed conveyor 12 that supplies the can C onto which the lid F has not been seamed to the seaming turret 11, a lid supply unit 14 that has a lid supply device 15 to supply the lid F and a lid conveyance turret 16, a double seam modification turret 20, a discharge turret 17 that carries out the double seamed can CM onto which the lid F has been seamed from the seaming turret 11, and a carrying-out conveyor 18 that carries out the modified double seamed can 22 from the discharge turret 17 to an outside. Each of the seaming turret 11, the discharge turret 17, the double seam modification turret 20 and the lid conveyance turret 16 has pockets P that separately accommodate and convey the cans C and the double seamed can CM, the modified double seam can 22 and the lid F at their outer peripheral parts, and the infeed conveyor 12 has attachments 13 that separately engage and convey the can C.

Each of the seaming turret 11, the double seam modification turret 20, the discharge turret 17, and the lid conveyance turret 16 has pockets P that separately accommodate and convey the cans C and the double seamed can CM, the modified double seam can 22, and the lid F at their outer peripheral parts, and the infeed conveyor 12 has attachments 13 that separately engage and convey the can C. Rotation speeds of the seaming turret 11, the double seam modification turret 20, the discharge turret 17, and the lid conveyance turret 16, a movement speed of the attachments 13 of the infeed conveyor 12, and a timing at which the respective pockets P and the attachments 13 work together are adjustably designed so that the cans C and the double seamed can CM, and the modified double seamed cans 22, and the lid F are smoothly transferred between the respective turrets and the conveyors. Turret directions of rotation are indicated by the arrows.

Figure 3:
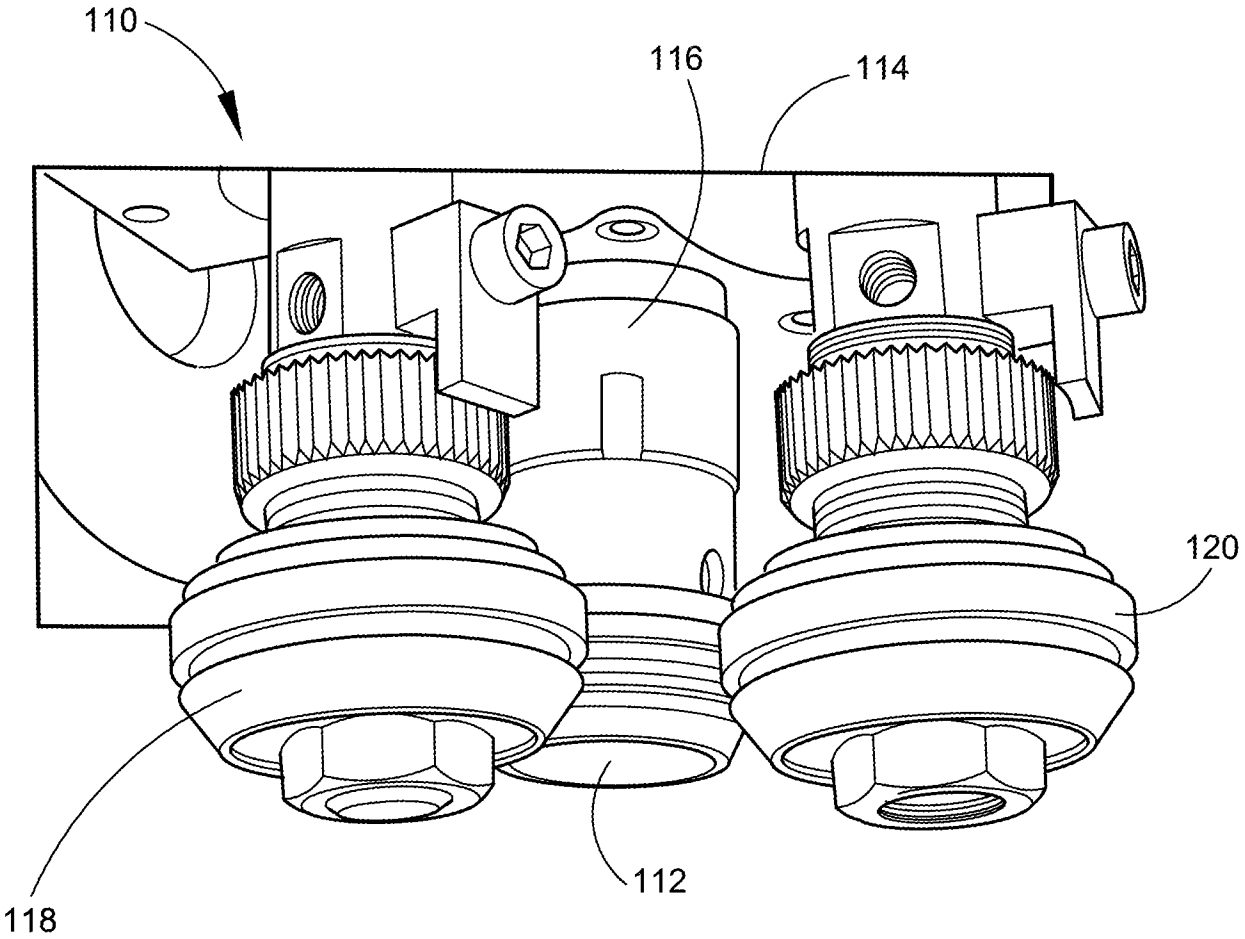
FIG. 3 PRIOR ART
FIG. 3 depicts a conventional prior art double seaming roller and chuck apparatus which includes a first double seaming roll that is constructed and arranged to perform a first double seaming operation on a workpiece consisting of a can body and a can end, and a second double seaming roll that is constructed and arranged to perform a second double seaming operation on the workpiece.

FIG. 3 depicts a conventional prior art double seaming apparatus 110, disclosed by Domijan in 2008 in U.S. Pat. No. 7,399,152 and hereby incorporated by reference herein. This device includes a first double seaming roll 118 that is constructed and arranged to perform a first double seaming operation on a workpiece consisting of a can body and a can end, and a second double seaming roll 120 that is constructed and arranged to perform a second double seaming operation on the workpiece. The drive mechanism 114 includes, as conventional, cam mechanisms for moving the first double seaming roll 118 into operative position relative to the double seaming chuck 112 during the first operation, and later moving the second double seaming roll 120 into operative position relative to the double seaming chuck 112 during the second operation. Such cam mechanisms are conventional, and are well-known to skilled artisans in this area of technology. FIG. 3 depicts an overall prior art system 110 containing several apparatuses connected to a conventional first drive mechanism 116, each of which is driven by a drive belt (not shown).

Figure 4:
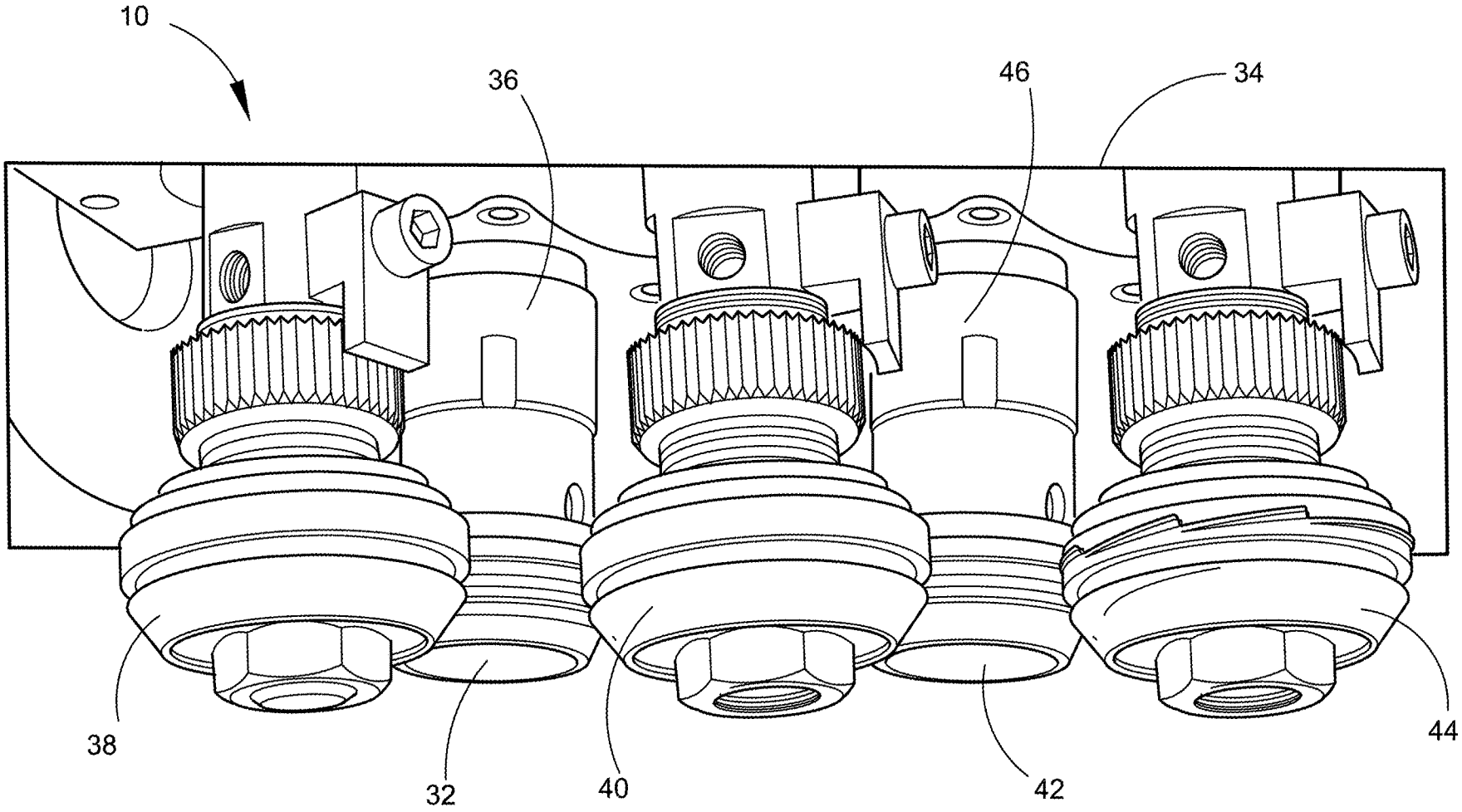
FIG. 4 illustrates an embodiment of the Double Seam Modification Tooling Apparatus and Double Seam Modification Process double seaming apparatus according to the present invention which includes a first double seaming roll that is constructed and arranged to perform a first double seaming operation on a workpiece consisting of a can body and a can end and/or lid, and a second double seaming roll that is constructed and arranged to perform a second double seaming operation on the workpiece.

FIG. 4 illustrates the double seam modification tooling apparatus for double seam modification 10 constructed in accordance with the present invention, which further includes a first double seaming roll 38 that is constructed and arranged to perform a first double seaming operation on a workpiece consisting of a can body and a can end, and a second double seaming roll 40 that is constructed and arranged to perform a second double seaming operation on the workpiece. The drive mechanism 34 includes, as conventional, cam mechanisms for moving the first double seaming roll 38 into operative position relative to the double seaming chuck 32 during the first operation, and later moving the second double seaming roll 40 into operative position relative to the double seaming chuck 32 during the second operation. Such cam mechanisms for the first and second double seam roll operations are conventional, and are well-known to skilled artisans in this area of technology. FIG. 4 also depicts an overall double seam modification tooling apparatus for double seam modification 10 system having a second chuck 42 active in the third modification operation as well as a third operation double seaming roll 44 which modifies the double seam after it is completed following double seaming operations 1 and 2. These several chuck and roll apparatuses are connected to a conventional first drive mechanism 36, and a second drive mechanism 46 wherein this second drive mechanism actively drives the inventive third modification operation. Each of the drive mechanisms are driven by one or more drive belts (not shown).

Figure 5:
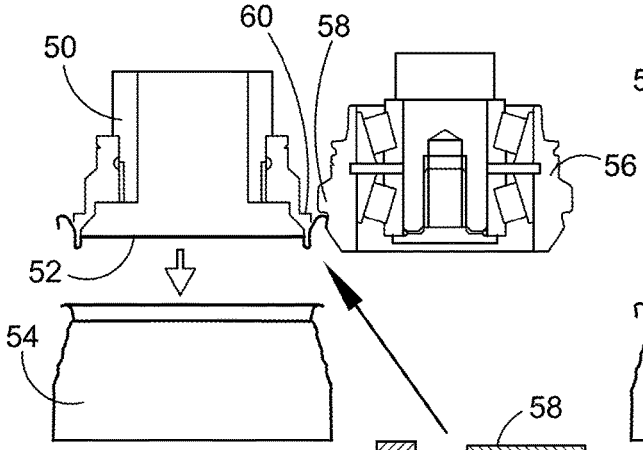
FIG. 5 depicts a side elevational cross-sectional view of the initial step of the conventional first double seaming operation where the lid and/or end is lowered onto the can.

FIG. 5 depicts a side elevational cross-sectional view showing the configuration of the chuck 50 and the lid 52 during the initial step, known as operation 1, of the conventional first double seaming operation where the lid 52 is lowered onto the can 54. Once the lid 52 is lowered onto the can 54 the double seaming chuck 50 and first seaming roller 56 engage the lid 52 and can 54 to begin the first seaming operation. The double seaming chuck 50 engages the lid 52 and can 54 at the double seaming chuck engagement point 60, whereas the first seaming roller 56 engages the lid 52 and can 54 at the first operation roller engagement point 58 (see FIG. 6).

Figure 6:
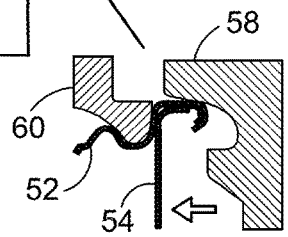
FIG. 6 depicts a side elevational cross-sectional close-up view of the initial step of the conventional first double seaming operation illustrating the relative positions of the chuck and roller a distance apart from each other before the first double seaming operation starts.

FIG. 6 depicts a side elevational cross-sectional close-up view of the initial step of the conventional first double seaming operation illustrating the positions of the lid 52 and can 54 relative to the double seaming chuck engagement point 60 and the first operation roller engagement point 58 a distance apart from each other before the first double seaming operation starts. Subsequently, the first operation roller engagement point 58 will move in the direction of the arrow towards the double seaming chuck engagement point 60 to initiate the first seaming operation.

Figure 7:
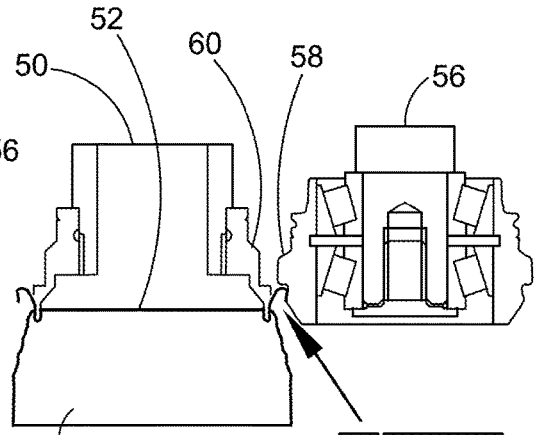
FIG. 7 depicts a side elevational cross-sectional view of the follow-up step of the conventional first double seaming operation where the lid is double seamed onto the can by the closing in of the chuck and first operation roller.

FIG. 7 depicts a side elevational cross-sectional view of the follow-up step of the conventional first double seaming operation where the lid 52 undergoes the first operation of double seaming onto the can 54 by the closing in of the double seaming chuck 50 and the first double seaming operation roller 56.

Figure 8:
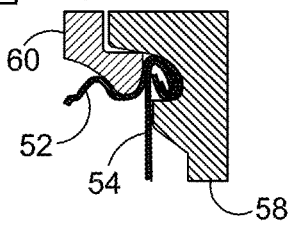
FIG. 8 depicts a side elevational cross-sectional close-up view of the follow-up step of the conventional first double seaming operation illustrating the relative positions of the chuck and roller in close proximity to each other to complete the first double seaming operation.

FIG. 8 depicts a side elevational cross-sectional close-up view of the follow-up step of the conventional first double seaming operation, illustrating the relative positions of the double seaming chuck engagement point 60 and the first operation roller engagement point 58 in close proximity to each other to facilitate the initial double seaming of the lid 52 to the can 54 thereby completing the first double seaming operation.

Figure 9:
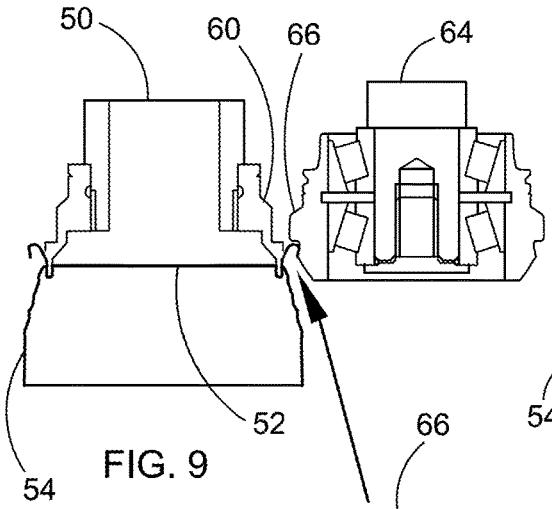
FIG. 9 depicts a side elevational cross-sectional view of the initial step of the conventional second double seaming operation where the lid is positioned between the second operation roll and chuck to initiate the second operation in double seaming the can.

FIG. 9 depicts a side elevational cross-sectional view of the initial step of the conventional second double seaming operation where the lid 52 and can 54 is positioned between the second operation double seaming roller 64 and double seaming chuck 50 to initiate the second operation in double seaming the lid 52 onto the can 54. The chuck 50 engages the lid 52 and can 54 at the chuck engagement point 60, whereas the second seaming roller 64 engages the lid 52 and can 54 at the second operation roller engagement point 66 (see FIG. 10).

Figure 10:
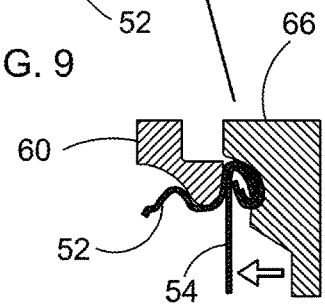
FIG. 10 depicts a side elevational cross-sectional close-up view of the initial step of the conventional second double seaming operation illustrating the relative positions of the chuck and second operation roller in close proximity to each other to complete the second double seaming operation.

FIG. 10 depicts a side elevational cross-sectional close-up view of the initial step of the conventional second double seaming operation illustrating the positions of the lid 52 and can 54 relative to the chuck engagement point 60 and the second operation roller engagement point 66 a distance apart from each other before the second double seaming operation starts. Subsequently, the second operation roller engagement point 66 will move in the direction of the arrow towards the chuck engagement point 60 to initiate the second seaming operation.

Figure 11:
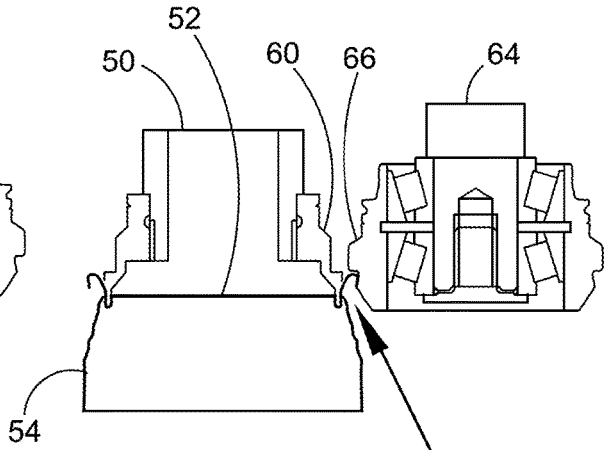
FIG. 11 depicts a side elevational cross-sectional view of the follow-up final step of the conventional second double seaming operation where the lid is fully double seamed onto the can by the closing in of the chuck and second operation roller.

FIG. 11 depicts a side elevational cross-sectional view of the follow-up final step of the conventional second double seaming operation where the lid is now fully double seamed onto the can by the closing in of the chuck and second operation roller completing the second double seaming operation and resulting in a double seamed lid and can. The lid 52 and can 54 is positioned between the second operation double seaming roller 64 and chuck 50 to initiate the second operation in double seaming the lid 52 onto the can 54. The chuck 50 engages the lid 52 and can 54 at the chuck engagement point 60, whereas the second seaming roller 64 engages the lid 52 and can 54 at the second operation roller engagement point 66 (see FIG. 12).

Figure 12:
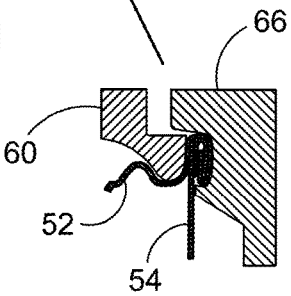
FIG. 12 depicts a side elevational cross-sectional close-up view of the follow-up final step of the conventional second double seaming operation illustrating the relative positions of the chuck and second operation roller in close proximity to each other to complete the second double seaming operation resulting in a fully double seamed can end and/or lid.

FIG. 12 depicts a side elevational cross-sectional close-up view of the follow-up final step of the conventional second double seaming operation illustrating the relative positions of the chuck engagement point 60 and the second operation roller engagement point 66 in close proximity to each other to facilitate the complete double seaming of the lid 52 to the can 54 thereby completing the second double seaming operation, resulting in a fully double seamed can end and/or lid.

Figure 13:
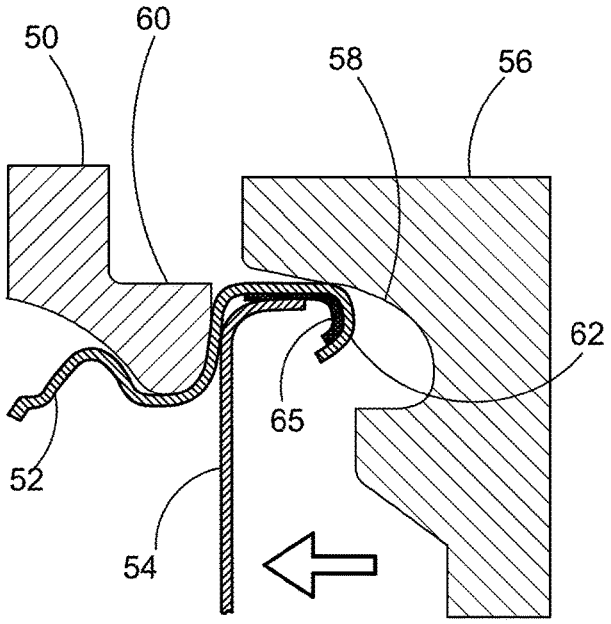
FIG. 13 depicts an enlarged cross-sectional view of FIG. 6, illustrating the initial step in the conventional first double seaming operation showing the open positions of the first operation double seaming chuck and first operation double seaming roller with direction arrow.

FIG. 13 depicts an enlarged cross-sectional view of FIG. 6, illustrating in greater detail the initial step in the conventional first double seaming operation showing the open positions of the double seaming chuck 50 and the first operation double seaming roller 56, relative to the lid 52 and can 54, including a direction arrow indicating the subsequent movement of the first operation double seaming roller 56 toward the double seaming chuck 50. The double seaming chuck 50 engages the lid 52 and can 54 at chuck engagement point 60, whereas the first operation double seaming roller 56 engages the lid 52 and can 54 at the first operation double seaming roller engagement point 58. Also shown here in FIG. 13 is the curved portion of the lid which will end up as one of the five layers of the five-layer double seam 62, and an optional adhesive material 65 often used when double seaming cans containing liquids, such as beverage and food products. The lid curved end portion will eventually end up as the inner most layer of the completed five-layer double seam 62, wherein three of the layers are from the lid 52 and two of the layers are from the can 54 wall. When optional adhesive material 65 is used, the resulting double seamed can will be liquid tight.

Figure 14:
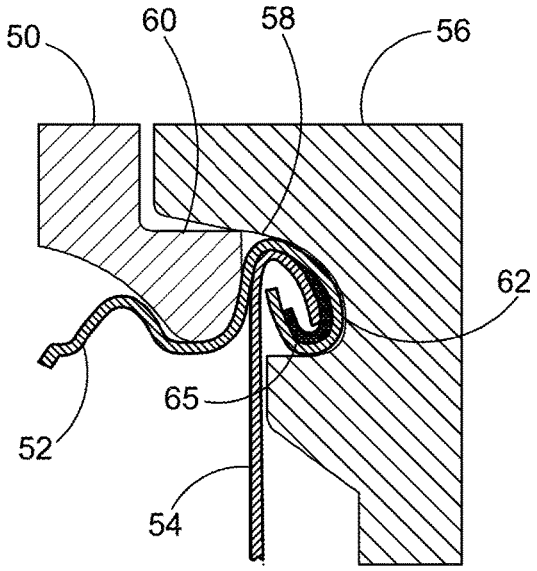
FIG. 14 depicts an enlarged cross-sectional view of FIG. 8, illustrating the follow-up step in the conventional first double seaming operation showing the compressed positions of the first operation double seaming chuck and the first operation double seaming roller.

FIG. 14 depicts an enlarged cross-sectional view of FIG. 8, illustrating in greater detail the follow-up step in the conventional first double seaming operation showing the compressed positions of the double seaming chuck 50 and the first operation double seaming roller 56. The chuck braces the lid and can at chuck engagement point 60 while the first operation roller 56 curls what will be the curved portion of the completed five-layer double seam 62 of the lid 52 at first operation roller engagement point 58 which has a gradually curved surface, when the chuck 50 and roller 56 are brought together and begin to curl and compress the lid 52 and can 54.

Figure 15:
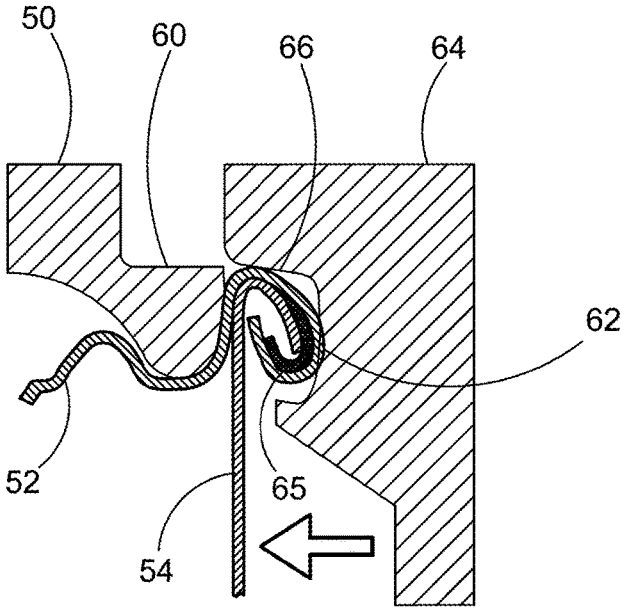
FIG. 15 depicts an enlarged cross-sectional view of FIG. 10, illustrating the initial step in the conventional second double seaming operation showing the open positions of the first double seaming chuck and second operation double seaming roller with direction arrow.

FIG. 15 depicts an enlarged cross-sectional view of FIG. 10, illustrating in greater detail the initial step in the conventional second double seaming operation showing the open positions of the double seaming chuck 50 and second operation double seaming roller 64, with a direction arrow indicating the movement of the second operation double seaming roller 64 towards the double seaming chuck 50. The double seaming chuck 50 engages the lid 52 and can 54 at chuck engagement point 60, whereas the second operation double seaming roller 64 engages the lid 52 and can 54 at the second operation double seaming roller engagement point 66. Also shown here in FIG. 15 is the curved portion of the partially seamed lid and can, which will eventually become the five layers of the five-layer double seam 62.

Figure 16:
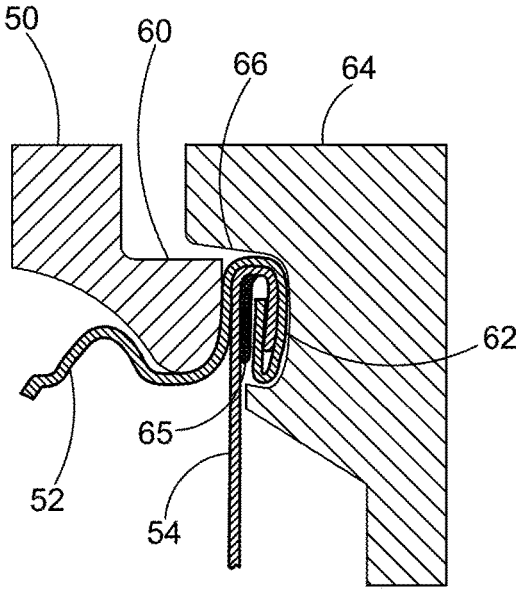
FIG. 16 depicts an enlarged cross-sectional view of FIG. 12, illustrating the follow-up step in the conventional second double seaming operation showing the compressed positions of the first double seaming chuck and second operation double seaming roller.

FIG. 16 depicts an enlarged cross-sectional view of FIG. 12, illustrating in greater detail the completion step in the conventional second double seaming operation showing the compressed positions of the double seaming chuck 50 and the second operation double seaming roller 64. The result of the completion step of the second double seaming operation is a completed five-layer double seam 62, shown here with optional adhesive material 65 applied to make the can liquid tight.

Figure 17:
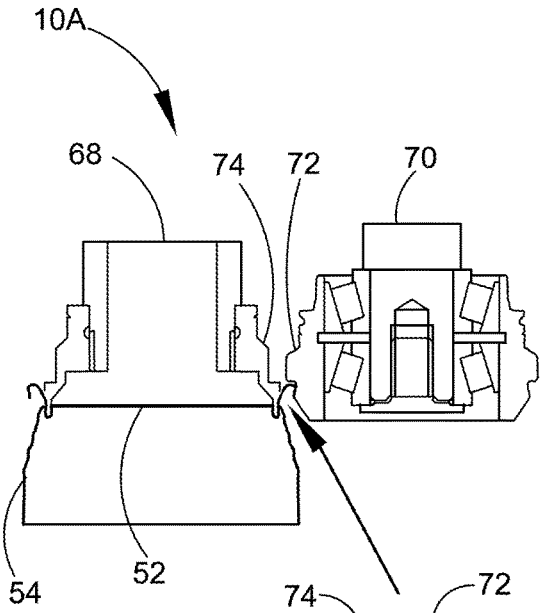
FIG. 17 depicts a side elevational cross-sectional view of the initial double seam modification step of the inventive third double seaming operation, according to the present invention, where the double seamed lid has entered the modification chuck and third modification operation roller to be modified by notching the double seam.

FIG. 17 depicts a side elevational cross-sectional view of the initial double seam notching modification step of the inventive third double seaming operation 10A, according to the present invention, where the double seamed lid has entered the third operation modification chuck 68 and the third operation modification roller 70 to be modified by notching the double seam completed in the first two operations. The third operation modification chuck 68 contacts the lid 52 and can 54 at the third operation modification chuck engagement point 74, and the third operation modification roller 70 contacts the lid 52 and can 54 at the third operation modification roller engagement point 72. The third operation modification roller engagement point 72 includes the notching modification punch 76 which punches notches in the completed double seam during the third modification operation, according to the present invention 10A.

Figure 18:
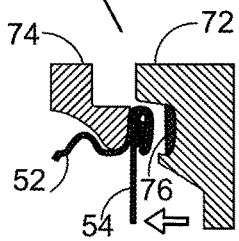
FIG. 18 depicts a side elevational cross-sectional close-up view of the initial double seam modification step of the inventive third double seaming operation, according to the present invention, where the double seamed lid is in position to be modified by the modification chuck and third modification operation roller resulting in the notching of the double seam.

FIG. 18 depicts a side elevational cross-sectional close-up view of the initial double seam notching modification step of the inventive third double seaming operation 10A, according to the present invention, where the completed double seamed lid 52 and can 54 is in position to be modified by the third operation modification chuck engagement point 74 and the third operation modification roller engagement point 72, which will subsequently result in the notching of the double seam. The direction arrow shows the movement direction of the third operation modification chuck engagement point 74 and the third operation modification roller engagement point 72 closing in toward each other.

Figure 19:
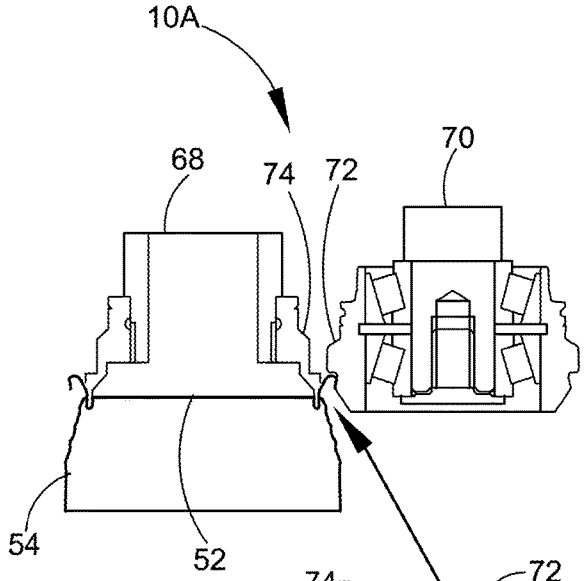
FIG. 19 depicts a side elevational cross-sectional view of the final double seam modification step of the inventive third double seaming operation, according to the present invention, where the double seamed lid has been modified by the compression of the modification chuck and third modification operation roller resulting in the notching of the double seam.

FIG. 19 depicts a side elevational cross-sectional view of the final double seam notching modification step of the inventive third double seaming operation 10A, according to the present invention, where the completed double seamed lid 52 and can 54 has been modified by the compression of the modification chuck and third modification operation roller resulting in the notching of the double seam. Here, the third operation modification chuck engagement point 74 and the third operation modification roller engagement point 72 have closed in compressing the double seam and when rotating punches notches into the completed double seam when the chuck 68 and roller 70 come together.

Figure 20:
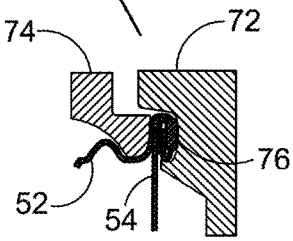
FIG. 20 depicts a side elevational cross-sectional close-up view of the final double seam modification step of the inventive third double seaming operation, according to the present invention, where the double seamed lid has been modified by the compression of the modification chuck and third modification operation roller resulting in the notching of the double seam.

FIG. 20 depicts a side elevational cross-sectional close-up view of the final double seam notching modification step of the inventive third double seaming operation 10A, according to the present invention, where the double seamed lid 52 and can 54 has been modified by the compression of the third operation modification chuck 68 and third modification operation roller 70, resulting in the third operation modification 10A notching of the double seam.

Figure 21:
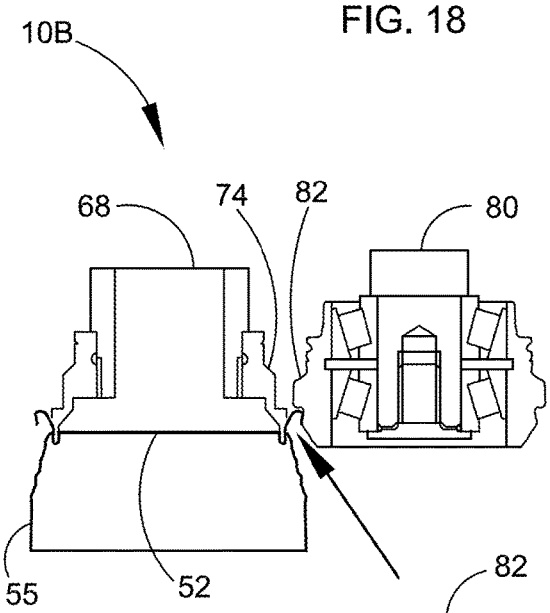
FIG. 21 depicts a side elevational cross-sectional view of the initial double seam modification step of the inventive third double seaming operation, according to the present invention, where the double seamed lid has entered the modification chuck and third modification operation roller to be modified by threading the double seam.

FIG. 21 depicts a side elevational cross-sectional view of the initial double seam threading modification step of the inventive third double seaming operation 10B, according to the present invention, where the double seamed lid 52 and can 55 has entered the alternate third modification chuck 68 and the alternate third modification operation roller 80 to be modified by threading the double seam. The completed double seamed lid 52 and can 55 is in position to be modified by the third operation modification chuck engagement point 74 and the alternate third operation modification roller engagement point 82, which will subsequently result in the threading of the double seam. The direction arrow shows the movement direction of the third operation modification chuck engagement point 74 and the alternate third operation modification roller engagement point 80 closing in toward each other. The alternate third operation modification roller engagement point 82 includes the notching modification punch 84 which punches threads in the completed double seam during the third modification operation, according to the present invention 10B.

Figure 22:
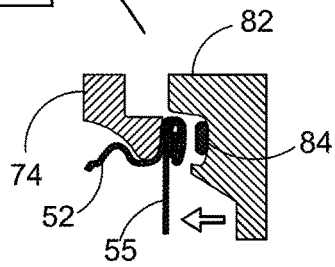
FIG. 22 depicts a side elevational cross-sectional close-up view of the initial double seam modification step of the inventive third double seaming operation, according to the present invention, where the double seamed lid is in position to be modified by the modification chuck and third modification operation roller resulting in the threading of the double seam.
Figure 23:
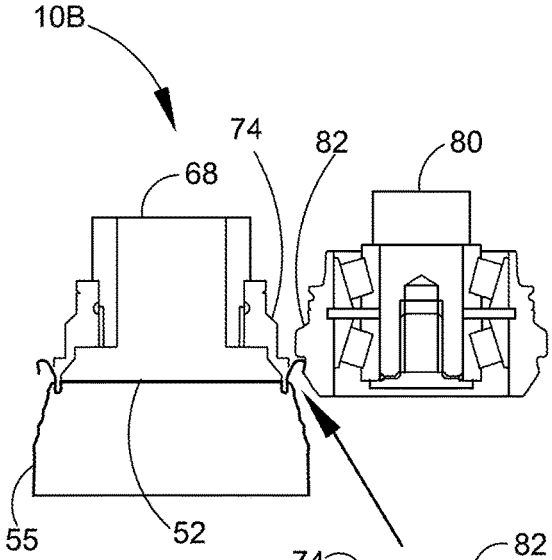
FIG. 23 depicts a side elevational cross-sectional view of the final double seam modification step of the inventive third double seaming operation, according to the present invention, where the double seamed lid has been modified by the compression of the modification chuck and third modification operation roller resulting in the threading of the double seam.

FIG. 22 depicts a side elevational cross-sectional close-up view of the initial double seam threading modification step of the inventive third double seaming operation 10B, according to the present invention, where the completed double seamed lid 52 and can 55 is in position to be modified by the modification chuck 68 and the alternate third modification operation roller 80, resulting in the threading of the double seam, according to the present invention 10B. As shown, the completed double seamed lid 52 and can 55 is in position to be modified by the third operation modification chuck engagement point 74 and the alternate third operation modification roller engagement point 82, which will subsequently result in the threading of the double seam. The direction arrow shows the movement direction of the third operation modification chuck engagement point 74 and the alternate third operation modification roller engagement point 80 closing in toward each other. The alternate third operation modification roller engagement point 82 includes the notching modification punch 84 which punches threads in the completed double seam during the third modification operation, according to the present invention 10B. FIG. 23 depicts a side elevational cross-sectional view of the final double seam threading modification step of the inventive third double seaming operation 10B, according to the present invention, where the double seamed lid 52 and can 55 has been modified by the compression of the modification chuck 68 and the alternate third modification operation roller 80, resulting in the alternate third modification operation threading of the double seam, according to the present invention 10B.

Figure 24:
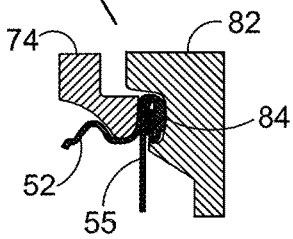
FIG. 24 depicts a side elevational cross-sectional close-up view of the final double seam modification step of the inventive third double seaming operation, according to the present invention, where the double seamed lid has been modified by the compression of the modification chuck and third modification operation roller resulting in the threading of the double seam.

FIG. 24 depicts a side elevational cross-sectional close-up view of the final double seam threading modification step of the inventive alternate third double seaming operation 10B, according to the present invention, where the double seamed lid 52 and can 55 has been modified by the compression of the alternate third operation modification chuck 68 and the alternate third modification operation roller 80, resulting in the alternate third operation modification 10B threading of the double seam. Here, the third operation modification chuck engagement point 74 and the alternate third operation modification roller engagement point 82 have closed in compressing the double seam and when rotating punches threads into the completed double seam when the third operation modification chuck 68 and the alternate third operation modification roller 80 come together.

Figure 25:
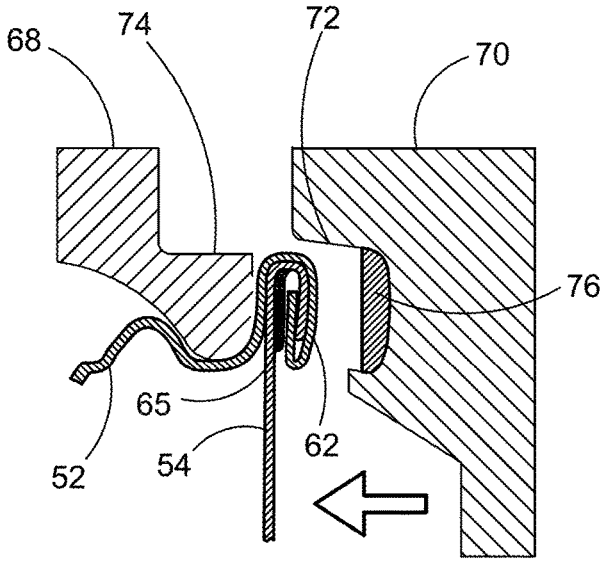
FIG. 25 depicts an enlarged cross-sectional view of FIG. 14, illustrating the initial step in the inventive third double seaming modification operation showing the open positions of the third operation double seaming chuck and third operation double seaming roller with direction arrow.

FIG. 25 depicts an enlarged cross-sectional view of FIG. 18, illustrating the initial step in the inventive third double seaming modification operation 10A showing the open positions of the third operation double seaming chuck and third operation double seaming roller with direction arrow. Here, as shown, the completed double seamed lid 52 and can 54 is in position to be modified by the third operation modification chuck 68 engagement point 74 and the third operation modification roller 70 engagement point 72, which will subsequently result in the notching of the double seam. The direction arrow shows the movement direction of the third operation modification chuck engagement point 74 and the third operation modification roller engagement point 72 closing in toward each other. The third operation modification roller engagement point 72 includes the notching modification punch 76 which punches notches in the completed double seam during the third modification operation, according to the present invention 10A.

Figure 26:
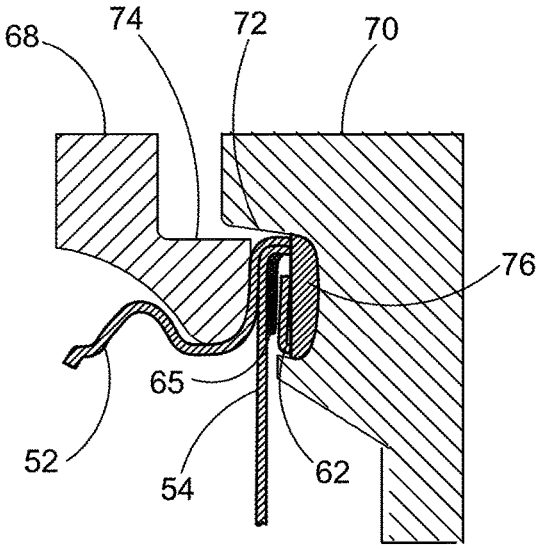
FIG. 26 depicts an enlarged cross-sectional view of FIG. 16, illustrating the follow-up step in the inventive third double seaming modification operation showing the compressed positions of the third operation double seaming chuck and the third operation double seaming roller.

FIG. 26 depicts an enlarged cross-sectional view of FIG. 20, illustrating the follow-up step in the inventive third double seaming modification operation 10A showing the compressed positions of the third operation double seaming chuck and the third operation double seaming roller. Here, as shown, the double seamed lid 52 and can 54 has been modified by the compression of the third operation modification chuck 68 and third modification operation roller 70, resulting in the third operation modification 10A notching of the double seam through the punching action of the notching punch 76 during the rotation of the third modification operation roller 70.

Figure 27:
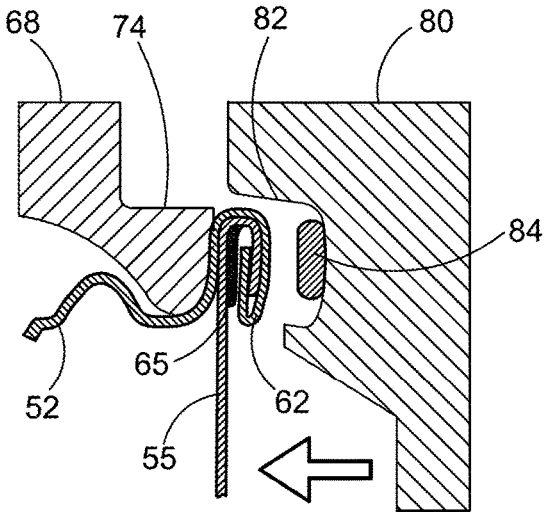
FIG. 27 depicts an enlarged cross-sectional view of FIG. 18, illustrating the initial step in the inventive third double seaming modification operation showing the open positions of the third double seaming chuck and third operation double seaming roller with direction arrow.

FIG. 27 depicts an enlarged cross-sectional view of FIG. 22, illustrating the initial step in the inventive third double seaming modification operation 10B showing the open positions of the third double seaming chuck and third operation double seaming roller with direction arrow. As shown, the completed double seamed lid 52 and can 55 is in position to be modified by the third operation modification chuck engagement point 74 and the alternate third operation modification roller engagement point 82, which will subsequently result in the threading of the double seam. The direction arrow shows the movement direction of the third operation modification chuck engagement point 74 and the alternate third operation modification roller engagement point 80 closing in toward each other. The alternate third operation modification roller engagement point 82 includes the notching modification punch 84 which punches threads in the completed double seam during the third modification operation, according to the present invention 10B.

Figure 28:
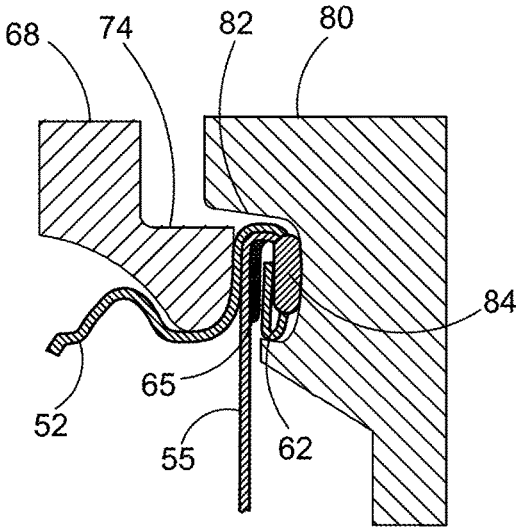
FIG. 28 depicts an enlarged cross-sectional view of FIG. 20, illustrating the follow-up step in the inventive third double seaming modification operation showing the compressed positions of the third double seaming chuck and third operation double seaming roller.

FIG. 28 depicts an enlarged cross-sectional view of FIG. 24, illustrating the follow-up step in the inventive third double seaming modification operation 10B showing the compressed positions of the third double seaming chuck and third operation double seaming roller. Here, the double seamed lid 52 and can 55 has been modified by the compression of the alternate third operation modification chuck 68 and the alternate third modification operation roller 80, resulting in the alternate third operation modification 10B threading of the double seam. Here, the third operation modification chuck engagement point 74 and the alternate third operation modification roller engagement point 82 have closed in compressing the double seam and when rotating punches threads into the completed double seam when the third operation modification chuck 68 and the alternate third operation modification roller 80 come together.

FIG. 29 depicts a top plan view of the configuration of the lid and can (not shown) being rotated by the third operation chuck 68 during the third operation double seam modification process, according to the present invention 10A. The third operation modification roller 70 includes the notching modification punch 76 which when rotating punches notches 86 into the completed double seam on the lid of a can. This results in the notched modified double seam (see FIG. 30 below).

FIG. 30 depicts a top plan view of a notched modified double seamed can lid 88 wherein the modification of the double seam was notching the completed double seam. The notching modification of the completed double seamed can lid 88 in this case was to accommodate a child resistant lid having mating tabs therein, which mating tabs mate with the notches in the double seamed can lid 88 when properly aligned, enabling a child resistant lid (see FIG. 31 below).

FIG. 31 depicts a bottom plan view of a child resistant can lid 90 which is configured to be applied to the modified notched double seam rim of a can by mating the modified notched double seam notches with the mating tabs 92 integrally molded into the child resistant lid.

FIG. 32 depicts a child resistant notched lid 90 and a notched double seam modified can rim on a double seamed can 54 wherein the lid 90 is configured to be mated with the modified double seam notches applied by the double seam modification process to the double seam rim of the can. In this regard, FIG. 32 illustrates an exploded perspective view of the preferred embodiment of the notched can 54 and mating tabbed lid 90 with the tightening grip surface. A locking segment 87 engages in the tapered slot 89 to pull down and tighten the lid 90 in position on the can 54. A plurality of narrower slots 86 preform similar tasks, but allow the lid 90 to only be installed in one position on the can 54, when the lid tabs 92 and double seam notches 86 are properly aligned.

FIG. 33 depicts a top plan view of the alternate third operation double seam modification roller punching threads into the completed double seam on the lid of a can. Here, FIG. 33 illustrates the configuration of the lid and can (not shown) being rotated by the third operation chuck 68 during the third operation double seam modification process, according to the present invention 10B. The third operation modification roller 80 includes the notching modification punch 84 which when rotating punches threads 92 into the completed double seam on the lid of a can. This results in the threaded modified double seam (see FIG. 34 below).

FIG. 34 depicts a child resistant threaded lid 94 having a gripping surface and a threaded double seam modified can rim on a double seamed can 55 wherein the lid 94 is configured to be mated with the modified double seam threads 99 applied by double seam modification to the double seam rim of the can. In this regard, FIG. 34 depicts an exploded perspective of the alternate embodiment of the threaded can 55 and lid 94 with the tightening grip surface. A locking segment nib 96 engages in the slot 98 having a tapered portion 99 to tighten the lid 94 in position on the can 55 when the lid 94 is rotated on to the threaded modified double seam of can 55.

FIG. 35 depicts a cross-sectional view of the child resistant lid and a partial cross section of the can rim illustrating a nib on the lid for securing the lid to the can once the lid is threaded on to the threaded double seam modified can rim. In this regard, FIG. 35 depicts an exploded perspective view of the alternate embodiment of the double seam modified threaded can 55 and lid 94 with the tightening grip surface. A locking segment nib 96 engages in the slot 98 having a tapered portion 99 (not shown, see FIG. 34 above) to tighten the lid 94 in position on the can 55.

Double Seam Modification Tooling Apparatus and Double Seam Modification Process primary features will include as prominent design and operational features: (1) a third operation modification chuck and a third operation modification roller configured to modify a completed double seam by notching the double seam; and (2) a third operation modification chuck and an alternate third operation modification roller configured to modify a completed double seam by threading the double seam. Both notching and threading of the double seam enable child resistant lids to be configured to mate with the notched and threaded double seam can rims.

The Double Seam Modification Tooling Apparatus and Double Seam Modification Process 10A, and 10B shown in the drawings and described in detail herein disclose arrangements of elements of particular construction and configuration for illustrating preferred embodiments of structure and method of operation of the present application. It is to be understood, however, that elements of different construction and configuration and other arrangements thereof, other than those illustrated and described may be employed for providing the Double Seam Modification Tooling Apparatus and Double Seam Modification Process 10A and 10B in accordance with the spirit of this disclosure, and such changes, alternations and modifications as would occur to those skilled in the art are considered to be within the scope of this design as broadly defined in the appended claims.

While certain embodiments of the inventions have been described, these embodiments have been presented by way of example only, and are not intended to limit the scope of the disclosure. Indeed, the novel methods and systems described herein may be embodied in a variety of other forms. Furthermore, various omissions, substitutions and changes in the systems and methods described herein may be made without departing from the spirit of the disclosure. For example, one portion of one of the embodiments described herein can be substituted for another portion in another embodiment described herein. The accompanying claims and their equivalents are intended to cover such forms or modifications as would fall within the scope and spirit of the disclosure. Accordingly, the scope of the present inventions is defined only by reference to the appended claims.

Features, materials, characteristics, or groups described in conjunction with a particular aspect, embodiment, or example are to be understood to be applicable to any other aspect, embodiment or example described in this section or elsewhere in this specification unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination, of the steps of any method or process so disclosed.

Furthermore, certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as a subcombination or variation of a subcombination.

Moreover, while operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Further, the operations may be rearranged or reordered in other implementations. Those skilled in the art will appreciate that in some embodiments, the actual steps taken in the processes illustrated and/or disclosed may differ from those shown in the figures. Depending on the embodiment, certain of the steps described above may be removed, others may be added. Furthermore, the features and attributes of the specific embodiments disclosed above may be combined in different ways to form additional embodiments, all of which fall within the scope of the present disclosure. Also, the separation of various system components in the implementations described above should not be understood as requiring such separation in all implementations, and it should be understood that the described components and systems can generally be integrated together in a single product or packaged into multiple products.

For purposes of this disclosure, certain aspects, advantages, and novel features are described herein. Not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Conditional language, such as "can," "could," "might," or "may," unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than 10% of, within less than 5% of, within less than 1% of, within less than 0.1% of, and within less than 0.01% of the stated amount. As another example, in certain embodiments, the terms "generally parallel" and "substantially parallel"

refer to a value, amount, or characteristic that departs from exactly parallel by less than or equal to 15 degrees, 10 degrees, 5 degrees, 3 degrees, 1 degree, or 0.1 degree.

The scope of the present disclosure is not intended to be limited by the specific disclosures of preferred embodiments in this section or elsewhere in this specification, and may be defined by claims as presented in this section or elsewhere in this specification or as presented in the future. The language of the claims is to be interpreted broadly based on the language employed in the claims and not limited to the examples described in the present specification or during the prosecution of the application, which examples are to be construed as non-exclusive.

Further, the purpose of the foregoing abstract is to enable the U.S. Patent and Trademark Office, foreign patent offices worldwide and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

I claim:

1. A double seam modification tooling apparatus comprising:

(a) a can infeed conveyor, a lid supply unit coupled to a lid conveyance turret, a double seaming zone turret, and a discharge turret, wherein said double seaming zone turret includes a double seaming chuck and a first double seaming operation roller for the purpose of carrying out the first operation in a double seaming process;

(b) said double seaming zone turret further including a second double seaming operation roller for the purpose of carrying out the second operation in a double seaming process, whereby the application of a double seam to a can and lid is completed; and (c) a modification turret located between said double seaming zone turret and said discharge turret, wherein said modification turret includes a third modification operation chuck and a third modification operation roller for the purpose of modifying the double seam applied to a can and lid in previously performed double seaming operation one and operation two, according to (a) and (b) above;

wherein said double seam applied to a can and lid are modified prior to being discharged by said discharge turret into a carry-out conveyor, wherein said third modification operation roller includes a plurality of punches for the purpose of modifying the double seam in a third operation following the previously performed operation one and operation two completed double seam.

2. The double seam modification tooling apparatus according to claim 1, wherein said plurality of punches includes a plurality of notch punches for the purpose of modifying the double seam in a third operation by notching the previously performed operation one and operation two completed double seam.

3. The double seam modification tooling apparatus according to claim 1, wherein said plurality of punches includes thread punches for the purpose of modifying the double seam in a third operation by threading the previously performed operation one and operation two completed double seam.

4. The double seam modification tooling apparatus according to claim 2, wherein said plurality of notch punches is integral to said third operation modification roller.

5. The double seam modification tooling apparatus according to claim 3, wherein said plurality of thread punches is integral to said third operation modification roller.

6. The double seam modification tooling apparatus according to claim 2, wherein the resulting modified double seam includes a plurality of notches.

7. The double seam modification tooling apparatus according to claim 3, wherein the resulting modified double seam includes a plurality of threads.

8. The double seam modification tooling apparatus according to claim 2, wherein a child resistant lid is configured with notch tabs to mate with said plurality of notches punched into the modified double seam when said notch tabs and double seam notches are aligned.

9. The double seam modification tooling apparatus according to claim 3, wherein a child resistant lid is configured with thread tabs to mate with said plurality of threads punched into the modified double seam when said thread tabs and double seam threads are aligned.

10. A double seam modification process comprising the steps of:

(a) providing a can infeed conveyor, a lid supply unit coupled to a lid conveyance turret, a double seaming zone turret, and a discharge turret, wherein said double seaming zone turret includes a double seaming chuck and a first double seaming operation roller for the purpose of carrying out the first operation in a double seaming process;

(b) providing said double seaming zone turret further including a second double seaming operation roller for the purpose of carrying out the second operation in a double seaming process, whereby the application of a double seam to a can and lid is completed; and (c) providing a modification turret located between said double seaming zone turret and said discharge turret, wherein said modification turret includes a third modification operation chuck and a third modification operation roller for the purpose of modifying the double seam applied to a can and lid in previously performed double seaming operation one and operation two, according to (a) and (b) above;

wherein said double seam applied to a can and lid are modified prior to being discharged by said discharge turret into a carry-out conveyor, wherein said third modification operation roller includes a plurality of punches for the purpose of modifying the double seam in a third operation following the previously performed operation one and operation two completed double seam.

11. The double seam modification process according to claim 10, wherein said plurality of punches includes a plurality of notch punches for the purpose of modifying the double seam in a third operation by notching the previously performed operation one and operation two completed double seam.

12. The double seam modification process according to claim 10, wherein said plurality of punches includes thread punches for the purpose of modifying the double seam in a third operation by threading the previously performed operation one and operation two completed double seam.

13. The double seam modification process according to claim 11, wherein said plurality of notch punches is integral to said third operation modification roller.

14. The double seam modification process according to claim 12, wherein said plurality of thread punches is integral to said third operation modification roller.

15. The double seam modification process according to claim 11, wherein the resulting modified double seam includes a plurality of notches.

16. The double seam modification process according to claim 12, wherein the resulting modified double seam includes a plurality of threads.

17. The double seam modification process according to claim 2, wherein a child resistant lid is configured with notch tabs to mate with said plurality of notches punched into the modified double seam when said notch tabs and double seam notches are aligned.

18. The double seam modification process according to claim 12, wherein a child resistant lid is configured with thread tabs to mate with said plurality of threads punched into the modified double seam when said thread tabs and double seam threads are aligned.

* * * * *